United States Patent [19]

Hasegawa et al.

[11] 4,036,650

[45] July 19, 1977

[54] HEAT DEVELOPABLE PHOTOSENSITIVE MATERIAL CONTAINING COMPOUNDS OF SULFUR

[75] Inventors: Noriko Hasegawa, Tokyo; Hajime Kobayashi, Mitaka; Ichiro Endo, Yokohama, all of Japan; Kikuo Kinjo, deceased, late of Tokyo, Japan, Kinjo, legal representative; by Ayako

[73] Assignee: Canon Kabushiki Kaisha, Tokyo, Japan

[21] Appl. No.: 608,006

[22] Filed: Aug. 26, 1975

[30] Foreign Application Priority Data

Aug. 27, 1974 Japan ..... 49-98661
Aug. 27, 1974 Japan ..... 49-98662

[51] Int. Cl.[2] ..... G03C 1/02; G03C 1/36; G03C 1/34

[52] U.S. Cl. ..... 96/114.1; 96/101; 96/109

[58] Field of Search ..... 96/114.1, 48 HD, 101, 96/109

[56] References Cited

U.S. PATENT DOCUMENTS

| | | | |
|---|---|---|---|
| 2,999,035 | 9/1961 | Sahler | 96/114.1 |
| 3,042,514 | 7/1962 | Roth | 96/114.5 |
| 3,232,758 | 2/1966 | Holstead et al. | 96/109 |
| 3,232,759 | 2/1966 | White et al. | 96/109 |
| 3,403,025 | 9/1968 | Rees et al. | 96/101 |
| 3,556,797 | 1/1971 | Pattiju et al. | 96/109 |
| 3,595,662 | 7/1971 | Willems et al. | 96/109 |
| 3,718,467 | 2/1973 | Inoue et al. | 96/48 |
| 3,801,330 | 4/1974 | Brinckman et al. | 96/48 HD |
| 3,854,954 | 12/1974 | Himmelmann et al. | 96/109 |

FOREIGN PATENT DOCUMENTS

| | | |
|---|---|---|
| 645,104 | 12/1927 | France |
| 49-35451 | 9/1974 | Japan |

*Primary Examiner*—David Klein
*Assistant Examiner*—Louis Falasco
*Attorney, Agent, or Firm*—Fitzpatrick, Cella, Harper & Scinto

[57] ABSTRACT

A heat developable photosensitive material capable of forming fogless and table images of high contrast which comprises at least an organic silver salt, a halide and at least one member selected from sulfur and sulfur compounds having a moiety of

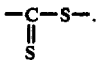

24 Claims, No Drawings

HEAT DEVELOPABLE PHOTOSENSITIVE MATERIAL CONTAINING COMPOUNDS OF SULFUR

BACKGROUND OF THE INVENTION

1. Field of the Invention

This invention relates to a heat developable photosensitive material containing an organic silver salt.

2. Description of the Prior Art

Photosensitive materials for forming silver images have been widely used and can give high quality images which can be formed at high sensitivity. As the materials for forming silver images, there are usually known materials using organic silver salts as well as conventional silver halide emulsions. The silver image forming heat developable photosensitive materials using organic silver salts can be developed only by a heat treatment after imagewise exposure. These silver image forming heat developable photosensitive materials can easily form images, in particular, the images can be formed by a dry process, and therefore, these materials have various advantages different from those resulting from conventional silver halide emulsions of a wet developing type and are expected to have wide application fields.

Such heat developable photosensitive materials comprising an organic silver salt contain an organic silver salt and a halide as essential components. As is known (see, e.g., "Imaging Materials and Systems," 1973 Symposium of Society of Photographic Scientists and Engineers, Tokyo, Japan, pages I-4-1 to I-4-9, such salt and halide, when mixed, react immediately to form the corresponding silver halide. The image formation is carried out by imagewise exposure of the heat developable photosensitive material and then heat development. In detail, the imagewise exposure causes the isolation of a small amount of silver resulting in the formation of a latent image, and the small amount of silver thus isolated can be the developing nucleus for silver isolated from the organic silver salt by the subsequent developing procedure to produce silver images at the exposed portions and thus complete the formation of visible images.

These heat developable photosensitive materials comprising an organic silver salt usually do not have a high sensitivity because the materials are not mainly composed of a photosensitive substance of high sensitivity as in the case of conventional silver halide emulsions, and further the original photosensitive composition remains at the non-exposed portion without being subjected to any change and therefore, isolation of silver at the non-exposed portion (non-image portion) is observed upon heat development, and it is very difficult to produce images of high contrast as in the case of a silver halide emulsion. In addition, even after the formation of images (silver images), the non-exposed portions have the same composition as that of the original (before exposure) photosensitive composition, and therefore, isolation of silver from the remaining organic silver salt is observed. Fogging phenomenon is observed after the formation of images. Consequently, it is not possible to maintain the image quality (particularly, contrast) obtained at the image formation, and the image stability is not sufficiently high.

SUMMARY OF THE INVENTION

According to the present invention, there is provided a heat developable photosensitive material which comprises an organic silver salt, a halide, a reducing agent and at least one member selected from the class of sulfur and sulfur compounds having a moiety of

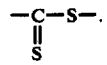

An object of the present invention is to provide a heat developable photosensitive material which comprises mainly an organic silver salt and which is free from the above-mentioned drawbacks.

Another object of the present invention is to provide a heat developable photosensitive material capable of producing a high image contrast.

A further object of the present invention is to provide a heat developable photosensitive material in which the isolation of silver from the organic silver salt at the exposed portion is accelerated upon heat developing while the isolation at the nonexposed portion is suppressed.

Still another object of the present invention is to provide a heat developable photosensitive material in which the isolation of silver from the remaining organic silver salt after the completion of formation of images (after development) is suppressed to maintain the image quality at the time of formation of said images without any change.

DESCRIPTION OF THE PREFERRED EMBODIMENTS

Representative sulfur compounds having a

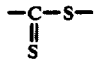

moiety are a compound having the formula

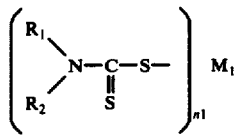

(1)

a compound having the formula

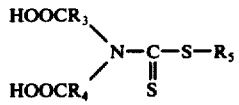

(2)

and a compound having the formula

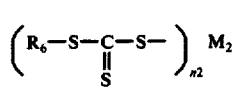

(3)

In the above formulas, $R_1$, $R_2$ and $R_6$ are similar or dissimilar, and are selected from the class of hydrogen, alkyl, alkanoyl, phenyl, tolyl, xylyl, benzyl and heterocyclic groups. The alkyl is preferably an alkyl having 1-5 carbon atoms. The alkanoyl is preferably an acyl having 1-4 carbon atoms. The heterocyclic group is preferably selected from benzothiazolyl, indolyl and oxazolyl.

$R_3$ and $R_4$ are similar or dissimilar, and are selected from the class of alkylene, phenylene, tolylene, dimethyl phenylene, and

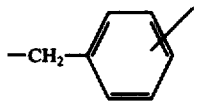

where the methylene group is attached to the nitrogen atom and the floating radical in the benzene ring to the carboxyl group.

$R_5$ is alkyl, preferably an alkyl having 1-5 carbon atoms.

$R_3$ and $R_4$ are preferably, similar or dissimilar, alkylene having 1-5 carbon atoms.

$M_1$ is selected from the class of a metal ion, an ammonium ion, an alkylammonium ion and a heterocyclic group.

$M_2$ is selected from the class of a metal ion, an ammonium ion, an alkylammonium ion and a heterocyclic group.

$n_1$ and $n_2$ are determined depending upon the valency of $M_1$ and that of $M_2$, respectively and are integers of 1-3.

In the definitions of $R_1$-$R_6$, the groups cited except hydrogen may have one or more substituents.

The substituents are preferably halogen, nitro, carboxyl and amino.

Representative heterocyclic groups are benzothiazolyl, oxazolyl and indolyl.

$M_1$ and $M_2$ are preferably select from the class of Li, Na, K, Rb, Cs, Cu, Ag, Au, Be, Mg, Ca, Sr, Ba, Zn, Cd, Hg, Al, Ga, In, Tl, Sn, Pb, Sb, Bi, Se, Te, Cr, Mo, Mn, Fe, Co, Ni, Pd, Pt, Rh and Ir. Particularly, as $M_1$ and $M_2$, the metal ions such as K, Na, Fe, Zn, Cu and Ag are preferable.

When $M_1$ and $M_2$ are an alkylammonium ion, an alkylammonium ion having 1-3 carbon atoms is preferable, and dimethylammonium ion and diethylammonium ion are more preferable. Preferable heterocyclic groups for $M_1$ and $M_2$ are benzothiazolyl, indolyl and oxazolyl.

The addition of sulfur or a sulfur compound to a heat developable photosensitive material comprising an organic silver salt according to the present invention results in the production of fogless and high contrast images of high stability. In particular, as is shown in the Examples, sulfur or the sulfur compounds of formulas (1), (2) and (3) accelerate isolation of silver at the light exposed portions and suppress isolation of silver at the non-exposed portions in the process of forming images, and further suppress spontaneous isolation of silver from the organic silver salt at various portions after the formation of images to maintain the original image quality. The sulfur or sulfur compound according to the present invention has excellent effects and is an additive different from the better than conventional image stabilizers, sensitizers, and image quality controlling agents.

Sulfur is particularly effective for suppressing isolation of silver from the organic silver salt at the non-exposed portions and further maintaining the original image quality while the sulfur compound of formula (1), (2) or (3) is effective for accelerating isolation of silver from the organic silver salt at the exposed portions.

Sulfur and the sulfur compounds of formulas (1), (2) and (3) have the desired effects regardless of the type of the the organic silver salt.

The amount of sulfur or the sulfur compound of formula (1), (2) or (3) is usually 0.01-10% by weight based on the weight of the organic silver salt, and preferably 0.05-1% by weight.

Representative sulfur compounds of formulas (1), (2) and (3) are as shown in Tables 1, 2 and 3, respectively.

Table 1

| Sulfur compunds of formula (1) | | | |
|---|---|---|---|
| $R_1$ | $R_2$ | $M_1$ | Compound |
| $CH_3$ | $CH_3$ | Na | Sodium dimethyldithiocarbamate |
| $C_2H_5$ | $C_2H_5$ | " | Sodium diethyldithiocarbamate |
| $CH_3$ | $CH_3$ | Zn | Zinc dimethyldithiocarbamate |
| $C_2H_5$ | $C_2H_5$ | Zn | Zinc diethyldithiocarbamate |
| $CH_3$ | $CH_3$ | Fe | Ferric dimethyldithiocarbamate |
| $C_2H_5$ | $C_2H_5$ | Fe | Ferric diethyldithiocarbamate |
| $CH_3$ | $CH_3$ | Cu | Cupric dimethyldithiocarbamate |
| $C_2H_5$ | $C_2H_5$ | Cu | Cupric diethyldithiocarbamate |
| $C_2H_5$ | $C_2H_5$ | Ag | Silver diethyldithiocarbamate |
| $CH_3$ | $CH_3$ | $N(CH_3)_2$ | Dimethylammonium dimethyldithiocarbamate |
| $C_2H_5$ | $C_2H_5$ | $N(C_2H_5)_2$ | Diethylammonium diethyldithiocarbamate |
| $C_2H_5$ | $C_2H_5$ | 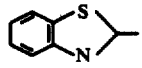 | Diethyldithiocarbamic acid 2-benzothiazolyl ester |
| $CH_3$ | $CH_3$ | K | Potassium dimethyldithiocarbamate |
| $C_2H_5$ | $C_2H_5$ | Cs | Desium diethyldithiocarbamate |
| $C_2H_5$ | $C_2H_5$ | Au | Gold diethyldithiocarbamate |
| $C_2H_5$ | $C_2H_5$ | Mg | Magnesium diethyldithiocarbamate |
| $CH_3$ | $CH_3$ | Ca | Calcium dimethyldithiocarbamate |
| $CH_3$ | $CH_3$ | Hg | Mercury dimethyldithiocarbamate |
| $CH_3$ | $CH_3$ | Al | Aluminum dimethyldithiocarbamate |
| $C_2H_5$ | $C_2H_5$ | Pb | Lead diethyldithiocarbamate |
| $C_2H_5$ | $C_2H_5$ | Se | Selenium diethyldithiocarbamate |
| $C_2H_5$ | $C_2H_5$ | Te | Tellurium diethyldithiocarbamate |
| $C_2H_5$ | $C_2H_5$ | Ni | Nickel diethyldithiocarbamate |
| H | H | Zn | Zinc dithiocarbamate |
| $C_4H_9$ | $C_4H_9$ | Zn | Zinc dibutyldithiocarbamate |
| $C_4H_9$ | $C_4H_9$ | Na | Sodium dibutyldithiocarbamate |
| $C_5H_{11}$ | $C_5H_{11}$ | Na | Sodium dipentyldithiocarbamate |
| $CH_3CO$ | $CH_3CO$ | Zn | Zinc diacetyldithiocarbamate |
| $C_3H_7CO$ | $C_3H_7CO$ | Zn | Zinc dibutyryl dithiocarbamate |
| $C_4H_9CO$ | $C_4H_9CO$ | K | Potassium divaleryl dithiocarbamate |
| $C_6H_5$ | $C_6H_5$ | Na | Sodium diphenyldithiocarbamate |
| $C_6H_5CH_2$ | $C_6H_5CH_2$ | Na | Sodium dibenzyldithiocarbamate |

Table 1-continued

| Sulfur compunds of formula (1) | | | |
|---|---|---|---|
| $R_1$ | $R_2$ | $M_1$ | Compound |
| 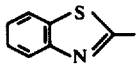 | $C_2H_5$ | Na | Sodium 2-benzothiazolylethyldithio-carbamate |
| 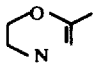 | $CH_3$ | Na | Sodium oxazolylmethyldithiocarbamate |
| $C_6H_5$ | $C_2H_5$ | Zn | Zinc ethylphenyldithiocarbamate |

Table 2

| Sulfur compounds of formula (1) | | | |
|---|---|---|---|
| $R_3$ | $R_4$ | $R_5$ | Compound |
| $CH_2$ | $CH_2$ | $C_3H_7$ | Propyl-N,N-diaceticaciddithiocarbamate |
| $CH_2$ | $CH_2$ | $CH_3$ | Methyl-N,N-diaceticaciddithiocarbamate |
| $CH_2$ | $CH_2$ | $C_2H_5$ | Ethyl-N,N-diaceticaciddithiocarbamate |
| $CH_2$ | $CH_2$ | $C_3H_7$ | Propyl-N,N-diaceticaciddithiocarbamate |
| $C_2H_4$ | $C_2H_4$ | $C_3H_7$ | Propyl-N,N-dipropionicaciddithiocarbamate |
| $CH_2$ | $C_2H_4$ | $C_3H_7$ | Propyl-N-aceticacid-N-propionicacid dithiocarbamate |
| $CH_2$ | $CH_2$ | $C_4H_9$ | Butyl-N,N-diaceticaciddithiocarbamate |
| $CH_2$ | $CH_2$ | $C_5H_{11}$ | Pentyl-N,N-diaceticaciddithiocarbamate |
| $C_3H_6$ | $C_3H_6$ | $C_2H_5$ | Ethyl-N,N-dibutyricaciddithiocarbamate |
| $C_4H_8$ | $C_4H_8$ | $C_2H_5$ | Ethyl-N,N-divalericaciddithiocarbamate |
| $C_5H_{10}$ | $C_5H_{10}$ | $C_3H_7$ | Propyl-N,N-dicaproicaciddithiocarbamate |
| $CH_2$ | $C_4H_8$ | $C_3H_7$ | Propyl-N-aceticacid-N-valericacid dithiocarbamate |
| $C_2H_4$ | $C_5H_{10}$ | $CH_3$ | Methyl-N-propionicacid-N-caproicacid dithiocarbamate |
| $C_6H_4$ | $C_6H_4$ | $C_2H_5$ | Ethyl-N,N-dibenzoicaciddithiocarbamate |
| $CH_3C_6H_3$ | $CH_3C_6H_3$ | $C_2H_5$ | Ethyl-N,N-di-toluicaciddithiocarbamate |
| $(CH_3)_2C_6H_2$ | $(CH_3)_2C_6H_2$ | $C_2H_5$ | Ethyl-N,N-di-xylylicaciddithiocarbamate |
| $-C_6H_4CH_2-$ | $-C_6H_4CH_2-$ | $C_2H_5$ | Ethyl-N,N-di-toluylicaciddithio-carbamate |

Table 3

| Sulfur compounds of formula (3) | | |
|---|---|---|
| $R_6$ | $M_2$ | Compound |
| $C_2H_5$ | K | Potassium ethylthioxanthate |
| $C_2H_5$ | Na | Sodium ethyl thioxanthate |
| $C_3H_7$ | K | Potassium propylthioxanthate |
| $C_3H_7$ | Na | Sodium propyl thioxanthate |
| $C_2H_5$ | Li | Lithium ethyl thioxanthate |
| $CH_3$ | Be | Beryllium methyl thioxanthate |
| $C_2H_5$ | Ba | Barium ethyl thioxanthate |
| $C_3H_7$ | Cd | Cadmium propyl thioxanthate |
| $C_3H_7$ | Tl | Thallium propyl thioxanthate |
| $C_2H_5$ | In | Indium ethyl thioxanthate |
| $C_2H_5$ | Ga | Gallium ethyl thioxanthate |
| $CH_3$ | Sn | Tin methyl thioxanthate |
| $CH_3$ | Sb | Antimony methyl thioxanthate |
| $C_2H_5$ | Bi | Bismuth ethyl thioxanthate |
| $CH_3$ | Cr | Chromium methyl thioxanthate |
| $CH_3$ | Mn | Manganese methyl thioxanthate |
| $C_2H_5$ | Pt | Platinum ethyl thioxanthate |
| $C_2H_5$ | Pd | Palladium ethyl thioxanthate |
| $C_2H_5$ | Co | Cobalt ethyl thioxanthate |
| $C_2H_5$ | Rh | Rhodium ethyl thioxanthate |
| $CH_3$ | $N(CH_3)_2$ | Dimethylammonium methylthioxanthate |
| $C_2H_5$ | $N(C_2H_5)_2$ | Diethylammonium ethylthioxanthate |
| $C_3H_7$ | $N(C_3H_7)_2$ | Dipropylammonium propylthioxanthate |
| $C_2H_5$ | 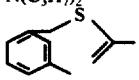 | Benzothiazolyl ethylthioxanthate |
| $C_2H_5$ | 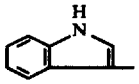 | Indolyl ethylthioxanthate |
| $C_2H_5$ | 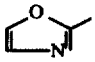 | Oxazolyl ethylthioxanthate |
| H | K | Potassium thioxanthate |
| $CH_3$ | Na | Sodium methylthioxanthate |
| $C_4H_9$ | Zn | Zinc butylthioxanthate |
| $C_5H_{11}$ | K | Potassium pentylthioxanthate |
| $CH_3CO$ | Na | Sodium acetylthioxanthate |
| $C_3H_7CO$ | Zn | Zinc butyrylthioxanthate |
| $C_4H_9CO$ | K | Potassium valerylthioxanthate |
| $C_6H_5$ | Na | Sodium phenylthioxanthate |
| $C_6H_5CH_2$ | Zn | Zinc benzylthioxanthate |
| $C_6H_4CH_3$ | K | Potassium tolylthioxanthate |
| $C_6H_3(CH_3)_2$ | Na | Sodium xylylthioxanthate |

Table 3-continued

| $R_6$ | $M_2$ | Sulfur compounds of formula (3) Compound |
|---|---|---|
| 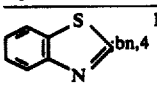 | Na | Sodium benzothiazolylthioxanthate |
| 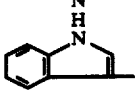 | Na | Sodium indolylthioxanthate |

The heat developable photosensitive material containing an organic silver salt according to the present invention may be prepared by using sulfur or a sulfur compound of formula (1), (2) or (3), an organic silver salt, a halide and a reducing agent. Usually, these components are dispersed in an insulating medium by using an appropriate solvent and applied to a substrate to form a photosensitive layer. The substrate may be a metal plate such as aluminum, copper, zinc, silver and the like, a metal laminate paper, a paper treated so as to prevent a solvent from penetrating, a paper treated with a conductive polymer, and plastics.

The reducing agent or sulfur or sulfur compound of formula (1), (2) or (3) may be incorporated in to the photosensitive layer, or coated on the photosensitive layer containing the organic silver salt by using an appropriate solvent to form a coating liquid, or incorporated in to a layer adjacent to the photosensitive layer. Further, sulfur or the sulfur compound of formula (1), (2) or (3) may be incorporated during the production of the organic silver salt, or added to a dispersion liquid of the organic silver salt, or coated, together with a reducing agent, on a layer containing the organic silver salt.

Representative organic silver salts used in the present invention are aliphatic acid silver salts containing not more than 25 carbon atoms such as silver behenate, silver arachidate, silver stearate, silver palmitate, silver myristate, silver laurate, silver caprylate, silver hydroxystearate, silver acetate, and silver butyrate, and other organic silver compounds such as silver benzoate, silver 4-n-octadecyloxydiphenyl-4-carboxylate, silver-o-aminobenzoate, silver acetoamidobenzoate, silver furoate, silver comphorate, silver p-phenylbenzoate, silver phenyl acetate, silver salicylate, silver terephthalate, silver phthalate, silver acid phthalate, silver phthalazinone, silver benzotriazole, silver saccharine and the like.

For the purpose of imparting photosensitivity to the organic silver salts, a halide as shown below may be applied to form the corresponding silver halide (by reaction with the organic silver salt): various inorganic halides such as $NH_4X$, $CrX_2$, $IrX_4$, $InX_4$, $CoX_2$, $CdX_2$, KX, HX, $SnX_2$, $SnX_4$, $SrX_2$, $TiX_3$, $TiX_4$, $CuX_2$, NaX, $PbX_2$, $NiX_2$, $PdX_2$, $MgX_2$, $AlX_3$, $ZnX_2$, $MnX_2$, $BaX_2$, $KAuX_4$, $HAuX_4$, $BiX_3$, CsX, $FeX_3$, AgX, $HgX_2$, $CaX_2$ and the like where X is chloro, bromo or iodo.

The amount of the halide may be optionally selected depending upon each purpose. It is preferably not higher than 10% by weight, more preferably $10^{-3}$–10% by weight based on the weight of the organic silver salt.

If desired, dye sensitizers, toning agents, stabilizers and other additives may be incorporated.

The developing procedure may be conducted by preliminarily incorporating a reducing agent such as substituted phenols, substituted naphthols and the like in to the photosensitive layer or coating it on the surface of the photosensitive layer and heat-developing.

Representative reducing agents are: hydroquinone, methyl hydroquinone, chlorohydroquinone, bromohydroquinone, catechol, pyrogallol, methylhydroxynaphthalene, aminophenol, 2,2'-methylene-bis-(6-t-butyl-4-methylphenol), 4,4'-butylidene-bis-(6-t-butyl-3-methylphenol), 4,4'-bis-(6-t-butyl-3-methylphenol), 4,4'-thio-bis-(6-t-2-methylphenol), octadecyl-3-(3',5'-di-t-butyl-4'-hydroxyphenyl) propionate, 2,6-di-t-butyl-p-cresol, 2,2'-methylene-bis-(4-ethyl-6-t-butylphenol), phenidone, metol, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl) methane and mixtures thereof.

For example, these reducing agent may be mixed with a resin such as cellulose acetate by using an optional solvent and applied to a surface of the photosensitive layer containing the organic silver salt.

It is also possible to carry out a developing procedure without incorporating a developing agent (a reducing agent) to the photosensitive layer, that is, it is possible to effect an external type of wet developing procedure. For example, a developing solution containing a reducing agent as mentioned above is applied to a buffer solution adjusted to a low pH. Fixing may be effected with a usual solution of sodium thiosulfate.

As the solvents for dispersing the organic silver salt in an insulating medium there may be mentioned methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene, xylene, acetone, methyl ethyl ketone, dioxane, tetrahydrofuran, dimethylamide, N-methyl-pyrrolidone, alcohols such as methyl alcohol, ethyl alcohol, isopropyl alcohol, butyl alcohol and the like, and water.

As the insulating medium, there may be mentioned polystyrene resin, polyvinyl chloride resin, phenolic resin, polyvinyl acetate resin, polyvinyl acetal resin, epoxy resin, xylene resin, alkyd resin, polycarbonate resin, poly (methyl-methacrylate) resin, polyvinyl butyral resin, gelatin resin, polyester, polyurethane, acetyl cellulose, synthetic rubber, polybutene, and the like.

If desired, there may be added a plasticizer. As the plasticizer, there may be mentioned dioctyl phthalate, tricresyl phosphate, diphenyl chloride, methyl naphthalene, p-terphenyl, diphenyl and the like.

The amount of the insulating medium upon forming the photosensitive layer is usually 0.02–20 parts by weight, preferably 0.1–5 parts by weight, per one part by weight of the organic silver salt compound.

The invention will be understood more readily by reference to the following examples. However, these examples are intended to illustrate the invention and are not to be construed to limit the scope of the invention.

EXAMPLE 1

In a ball mill, 10g. of silver behenate, 150g. of methyl ethyl ketone, 150g. of toluene and 15g. of silica powder (Syloid No. 244, a trade name for a product of Fuji Davison Chemical Ltd.) were mixed, pulverized and dispersed for 72 hours. Then, 9g. of polyvinyl butyral was added to the resulting dispersed mixture and further ball-milled for 15 minutes. 20mg. of sodium diethyldithiocarbamate (the sulfur compound) in 8ml. of methanol was added thereto and sufficiently uniformly mixed to prepare a first composition. (The sodium diethyldithiocarbamate is represented by the general formula [1] wherein both $R_1$ and $R_2$ are ethyl and M is sodium). The resulting mixture was coated onto a two-sided art paper of 100 microns in thickness with a coating rod so as to be 8 microns in thickness after drying.

In 19g. of acetone were mixed and dissolved 1g. of 2,6-di-t-butyl-p-cresol, 0.5g. of 1-phthalazone, 1g. of acetyl cellulose and 5mg. of ammonium bromide, and the resulting solution (second composition) was coated in the dark onto the silver behenate-containing layer formed as described above so as to be 12 microns in thickness after drying to prepare Sample-A.

On the other hand, Sample-B for comparison was prepared in the same manner as that mentioned above except that no sodium diethyldithiocarbamate was used in forming the silver behenate-containing layer.

The above-mentioned Samples A and B were exposed to a tungsten light source (1500 lux) and heat-developed by using a roller type heat developing apparatus to form visualized images. The density of the images was measured by means of a densitometer (supplied by Nalumi Ltd.) to make a comparison with respect to various characteristics of the samples. The results are shown in the following table.

I. Relative Sensitivty etc. (Exposure time : 30 sec., Heat development for 3 sec. at 120° C)

| | Sample-A | Sample-B |
|---|---|---|
| (a) Relative Sensitivity | 20.1 | 1 |
| (b) Maximum Density (D max) | 1.20 | 0.50 |
| (c) Fog Density (D min) | 0.20 | 0.10 |
| (d) Shelf-life* | 180 days | 30 days |

*Period of time required for reduction of sensitivity by half.

II. Development Latitude (Exposure time : 30 sec.)

| Developing time (at 120° C)(seconds) | Sample-A | | Sample-B | |
|---|---|---|---|---|
| | Dmax | Dmin | Dmax | Dmin |
| 1 | 0.30 | 0.10 | 0.10 | 0.10 |
| 2 | 0.70 | 0.10 | 0.20 | 0.10 |
| 3 | 1.20 | 0.20 | 0.50 | 0.10 |
| 4 | 1.30 | 0.20 | 0.60 | 0.40 |
| 5 | 1.40 | 0.20 | 0.60 | 0.50 |
| Developing Temperature (Developing time of 3 sec.) (° C) | | | | |
| 100 | 0.60 | 0.10 | 0.10 | 0.10 |
| 110 | 0.80 | 0.20 | 0.20 | 0.10 |
| 120 | 1.20 | 0.20 | 0.50 | 0.10 |
| 130 | 1.50 | 0.40 | 0.60 | 0.40 |
| 150 | 1.50 | 0.90 | 0.60 | 0.60 |

In the above table, the relative sensitivities were obtained in such a manner that the Samples were exposed through a grey scale and subjected to heat development and then the density of the obtained images was measured by a densitometer (supplied by Nalumi Ltd.) to calculate the relative sensitivities from the relation between the exposure amount and the density. The maximum density represents the density of the image obtained by exposing the samples to the above-mentioned light source for a predetermined time without the use of a grey scale followed by the development. The fog density represents the density of the unexposed portion after the heat-development. The shelf-life is the longer one of the following two periods of time: (1) the period of time required for reduction of the sensitivity by half and (2) the period of time required for reduction of the relative sensitivity by half. (In this case, it is the former period of time.)

EXAMPLE 2

Photosensitive materials were prepared by the same procedure as that in Example 1 except that various compounds were used as the sulfur compound, and the wavelength edge of the photosensitivity range and relative sensitivities were measured, the results of which are shown in the following table. In addition, the measurement of the wavelength edge of the photosensitivity range was conducted by a grating spectrograph (RM-23-1, a trade name for a product of Nalumi Ltd.) provided with a xenon light source. The other measurement was conducted in the same manner as that in Example 1.

| Sulfur Compound | Wavelength edge of photosensitivity range (nm) | Relative Sensitivity |
|---|---|---|
| (Group-I)* | | |
| None | 470 | 0.05 |
| Sodium diethyldithiocarbamate | 520 | 1 |
| Dimethylammonium dimethyldithiocarbamate | 520 | 0.70 |
| Diethylammonium diethyldithiocarbamate | 510 | 1.10 |
| 2-benzthiazolyl diethyldithiocarbamate | 490 | 0.40 |
| Zinc dimethyldithiocarbamate | 530 | 0.65 |
| Zinc diethyldithiocarbamate | 530 | 0.75 |
| Ferric dimethyldithiocarbamate | 520 | 0.75 |
| Ferric diethyldithiocarbamate | 520 | 0.95 |
| Cupric dimethyldithiocarbamate | 500 | 0.72 |
| Cupric diethyldithiocarbamate | 520 | 1.10 |
| Sodium dimethyldithiocarbamate | 530 | 0.40 |
| Silver diethyldithiocarbamate | 510 | 1.05 |
| (Group-II)** | | |
| n-propyl-N,N-di-acetic acid dithiocarbamate | 500 | 0.50 |
| Methyl-N,N-di-acetic acid dithiocarbamate | 500 | 0.40 |
| Ethyl-N,N-di-acetic acid dithiocarbamate | 500 | 0.40 |
| n-propyl-N,N-di-acetic acid dithiocarbamate | 500 | 0.50 |
| n-propyl-N,N-di-propionic acid dithiocarbamate | 510 | 0.50 |

-continued

| Sulfur Compound | Wavelength edge of photosensitivity range (nm) | Relative Sensitivity |
|---|---|---|
| n-propyl-N-acetic acid-N-propionic acid dithiocarbamate (Group-III)*** | 510 | 0.40 |
| Potassium ethyl thioxanthate | 490 | 0.72 |
| Sodium ethyl thioxanthate | 500 | 0.90 |
| Potassium n-propyl thioxanthate | 500 | 0.90 |
| Sodium n-propyl thioxanthate | 500 | 0.90 |

* Sulfur compound of the general formula (1).
** Sulfur compound of the general formula (2).
***Sulfur compound of the general formula (3).

EXAMPLE 3

A sample was prepared in the same manner as that in Example 1 except that 17g. of an equimolar mixture of silver behenate and behenic acid was used in place of 10g. of the silver behenate. When the sample thus prepared was exposed under the same conditions as in Example 1, a developing time of 5 seconds (at 120° C) was required to obtain the maximum density (1.20) of the image which was obtained by the heat development at 120° C for 3 seconds in Example 1. On the other hand, the fog density was 0.15 or less so that the development latitude was found to be improved.

EXAMPLE 4

In a ball mill, 10g. of silver benztriazole and 150g. of ethanol were mixed and dispersed for 72 hours, to which 10g. of polyvinyl butyral was then added and further ball-milled for 15 minutes. As the sulfur compound, 50mg. of diethylammonium diethyldithiocarbamate was added to the resulting mixture to prepare a first composition, which was coated onto a baryta paper by means of a coating rod.

| | |
|---|---|
| Sodium bromide | 0.05g. |
| 4,4'-thiobis (6-t-butyl-3-methylphenol) | 2g. |
| Phthalic acid | 0.05g. |
| Acetyl cellulose (10% acetone solution) | 10g. |
| Acetone | 30g. |

A second composition of the above-mentioned ingredients was coated onto the first composition layer to prepare Sample-C.

On the other hand, Sample-D was prepared in the same manner as above except that no diethylammonium diethyldithiocarbamate was used.

These samples were exposed to a tungsten lamp (500 lux) through a grey scale and subjected to heat development at 150° C for 5 seconds to obtain the following results.

| | Sample-C | Sample-D |
|---|---|---|
| (a) Relative Sensitivity | 2.5 | 1 |
| (b) Maximum Density | 1.01 | 0.70 |
| (c) Fog Density | 0.30 | 0.30 |

EXAMPLE 5

To the second composition used in Example 1 containing 2,6-di-t-butyl-p-cresol was added 5mg. of a dye sensitizer of the formula:

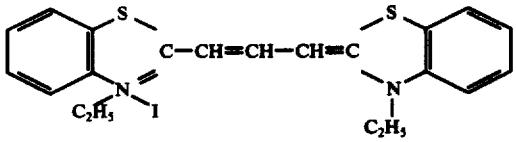

The same procedure as that for preparing Sample-A was repeated except that the above-mentioned composition was used in place of the second composition to prepare Sample-E.

The characteristics of Sample-E were measured in the same manner as in Example 1 to obtain the results shown in the following table.

| | Sample-A | Sample-E |
|---|---|---|
| Relative Sensitivity | 1 | 2.2 |
| Maximum Density | 1.20 | 1.20 |
| Fog Density | 0.20 | 0.30 |
| Wavelength edge of photosensitivity range | 520nm | 600nm |

EXAMPLE 6

Using the same procedure as in Example 2, various sulfur compounds of the general formulae (1)–(3) were used to prepare photosensitive materials and their relative sensitivities were measured. The results are shown below. In this connection, as in Example 2, the photosensitive material containing sodium diethyldithiocarbamate, Sample-A was selected as the standard for evaluating the sensitivity, that is, 1.

| Sulfur Compound | Relative sensitivity |
|---|---|
| 1. Sulfur compound of the general formula (1): | |
| Potassium dimethyldithiocarbamate | 0.80 |
| Cesium diethyldithiocarbamate | 1.05 |
| Gold diethyldithiocarbamate | 0.90 |
| Magnesium diethyldithiocarbamate | 0.70 |
| Calcium dimethyldithiocarbamate | 0.40 |
| Mercury dimethyldithiocarbamate | 0.55 |
| Aluminum dimethyldithiocarbamate | 0.75 |
| Lead diethyldithiocarbamate | 0.95 |
| Selenium diethyldithiocarbamate | 0.30 |
| Tellurium diethyldithiocarbamate | 0.35 |
| Nickel diethyldithiocarbamate | 0.95 |
| Zinc dithiocarbamate | 0.20 |
| Zinc dibutyldithiocarbamate | 0.70 |
| Sodium dibutyldithiocarbamate | 0.90 |
| Sodium dipentyldithiocarbamate | 0.75 |
| Zinc diacetyldithiocarbamate | 0.45 |
| Zinc dibutyryldithiocarbamate | 0.40 |
| Potassium divaleryldithiocarbamate | 0.40 |
| Sodium diphenyldithiocarbamate | 0.60 |
| Sodium dibenzyldithiocarbamate | 0.55 |
| Sodium 2-benzothiazolylethyldithiocarbamate | 0.70 |
| Sodium oxazolylmethyldithiocarbamate | 0.40 |
| Zinc ethylphenyldithiocarbamate | 0.60 |
| 2. Sulfur compound of the general formula (2): | |

-continued

| Sulfur Compound | Relative sensitivity |
|---|---|
| Butyl-N,N-di-acetic acid dithiocarbamate | 0.30 |
| Pentyl-N,N-di-acetic acid dithiocarbamate | 0.50 |
| Ethyl-N,N-di-butylic acid dithiocarbamate | 0.35 |
| Ethyl-N,N-di-valeric acid dithiocarbamate | 0.30 |
| Propyl-N,N-di-caproic acid dithiocarbamate | 0.20 |
| Propyl-N-acetic acid-N-valeric acid dithiocarbamate | 0.25 |
| Methyl-N-propionic acid-N-caproic acid dithiocarbamate | 0.15 |
| Ethyl-N,N-di-benzoic acid dithiocarbamate | 0.15 |
| Ethyl-N,N-di-toluic acid dithiocarbamate | 0.15 |
| Ethyl-N,N-di-xylylic acid dithiocarbamate | 0.15 |
| Ethyl-N,N-di-toluylic acid dithiocarbamate | 0.15 |
| 3. Sulfur compound of the general formula (3): | |
| Lithium ethyl thioxanthate | 0.50 |
| Beryllium methyl thioxanthate | 0.75 |
| Barium ethyl thioxanthate | 0.40 |
| Cadmium propyl thioxanthate | 0.50 |
| Thallium propyl thioxanthate | 0.75 |
| Indium ethyl thioxanthate | 0.70 |
| Gallium ethyl thioxanthate | 0.60 |
| Tin methyl thioxanthate | 0.45 |
| Antimony methyl thioxanthate | 0.45 |
| Bismuth ethyl thioxanthate | 0.60 |
| Chromium methyl thioxanthate | 0.60 |
| Manganese methyl thioxanthate | 0.70 |
| Platinum ethyl thioxanthate | 0.75 |
| Palladium ethyl thioxanthate | 0.75 |
| Cobalt ethyl thioxanthate | 0.70 |
| Rhodium ethyl thioxanthate | 0.70 |
| Dimethylammonium methyl thioxanthate | 0.45 |
| Diethylammonium ethyl thioxanthate | 0.50 |
| Dipropylammonium propyl thioxanthate | 0.60 |
| Benzothiazolyl ethyl thioxanthate | 0.55 |
| Indolyl ethyl thioxanthate | 0.45 |
| Oxazolyl ethyl thioxanthate | 0.20 |
| Potassium thioxanthate | 0.30 |
| Sodium methyl thioxanthate | 0.45 |
| Zinc butyl thioxanthate | 0.45 |
| Potassium pentyl thioxanthate | 0.45 |
| Sodium acetyl thioxanthate | 0.30 |
| Zinc butryl thioxanthate | 0.30 |
| Potassium valeryl thioxanthate | 0.30 |
| Sodium phenyl thioxanthate | 0.45 |
| Zinc benzyl thioxanthate | 0.50 |
| Potassium tolyl thioxanthate | 0.50 |
| Sodium xylyl thioxanthate | 0.50 |
| Sodium benzothiazolyl thioxanthate | 0.50 |
| Sodium indolyl thioxanthate | 0.50 |

EXAMPLE 7

In a ball mill, 10g. of silver behenate, 150g. of methyl ethyl ketone, 150g. of toluene and 15g. of silica powder (Syloid No. 244, a trade name for a product of Fuji Davison Chemical Ltd.) were mixed, pulverized and dispersed for 72 hours, to which 90g. of polyvinyl butyral was then added and further ball-milled for 15 minutes. The resulting slurry was coated onto a two sided art paper of 100 microns in thickness by means of a coating rod and dried to form a first composition layer.

| | |
|---|---|
| 2,6-di-t-butyl-p-cresol | 1g. |
| 1-phthalazone | 0.5g. |
| Acetyl cellulose | 1g. |
| Acetone | 19g. |

These ingredients were mixed and dissolved, to which 5mg. of ammonium bromide in 1ml. of methanol was added. To the resulting solution was further added 2mg. of crystalline sulfur in 1ml. of toluene and the mixture (a second composition) was coated onto the above-mentioned silver behenate layer in the dark and dried to prepare Sample-F.

| | |
|---|---|
| Silver benztriazole | 10g. |
| Ethyl alcohol | 150g. |

On the other hand, Sample-G for comparison was prepared using the same procedure as that mentioned above except that no crystalline sulfur was used for the 2,6-di-t-butyl-p-cresol containing layer.

These Samples-F and G were exposed to a tungsten light source (5000 lux) and then subjected to heat development by means of a heat developing apparatus of the roller type to form visualized images thereon. The density of the images was measured by a densitometer (supplied by Nalumi Ltd.) to make a comparison with respect to the characteristics of the samples.

I. Image quality (Exposure time : 10 sec., Heat development for 3 sec. at 120° C)

| | Sample-F | Sample-G |
|---|---|---|
| Maximum Density | 1.2 | 0.5 |
| Fog Density | 0.2 | 0.3 |
| Light resistance* | +0.03 | +0.30 |

*Change in the density of the unexposed portion after the samples were exposed to a fluorescent lamp (Macbeth prooflite viewer Model TLT-510, a trade name for a product of Macbeth Color & Photometry Division Kollmorgen Corp.) having a color temperature of 5000° K for 2 hours.

II. Development Latitude (Exposure time : 3 sec.)

| Developing (time) (at 120° C) (seconds) | Sample-F Dmax | Sample-F Dmin | Sample-G Dmax | Sample-G Dmin |
|---|---|---|---|---|
| 1 sec. | 0.3 | 0.1 | 0.1 | 0.1 |
| 2 | 0.7 | 0.1 | 0.2 | 0.1 |
| 3 | 1.3 | 0.2 | 0.5 | 0.3 |
| 4 | 1.3 | 0.2 | 0.6 | 0.4 |
| 5 | 1.4 | 0.2 | 0.6 | 0.5 |
| Developing temperature (for 3 sec.)(° C) | | | | |
| 100 | 0.6 | 0.1 | 0.1 | 0.2 |
| 110 | 0.9 | 0.2 | 0.2 | 0.2 |
| 120 | 1.3 | 0.2 | 0.5 | 0.3 |
| 130 | 1.3 | 0.2 | 0.6 | 0.3 |
| 150 | 1.3 | 0.3 | 0.6 | 0.5 |

EXAMPLE 8

A sample was prepared using the same procedure as in Example 7 except that 17g. of an equimolar mixture of silver behenate and behenic acid was used in place of 10g. of silver behenate.

The sample thus prepared was exposed under the same conditions as in Example 7, in case of which a developing time of 7 second (at 120° C) was necessary to obtain the same maximum density (1.3) as that obtained in Example 7. On the other hand, the fog density was 0.15 or less and it was found that the development latitude was further improved.

EXAMPLE 9

| | |
|---|---|
| Silver benztriazole | 10g. |
| Ethyl alcohol | 150g. |

In a ball mill, these ingredients were mixed and dispersed for 72 hours. Then, 10g. of polyvinyl butyral was added thereto and further ball-milled for 15 minutes to prepare a first composition.

The first composition was coated onto a baryta paper by a coating rod.

| | |
|---|---|
| Sodium bromide | 0.05g. |
| 4,4' - thiobis (6 - t-butyl - 3 - methylphenol) | 2g. |
| Phthalic acid | 0.05g. |

-continued

| | |
|---|---|
| Acetyl cellulose | 10g. |
| Acetone | 30g. |
| Crystalline sulfur (20mg./1cc toluene) | 1cc |

A second composition of the above-mentioned ingredients was coated onto the first composition layer to prepare Sample-H.

On the other hand, the above-mentioned procedure was repeated except that no crystalline sulfur was used to prepare Sample-I.

These samples were exposed to a tungsten lamp (5000 lux) through a grey scale and subjected to heat development at 150° C for 5 seconds to obtain the following results.

| | Sample-H | Sample-I |
|---|---|---|
| Maximum Density | 1.0 | 0.7 |
| Fog Density | 0.25 | 0.3 |
| Light Resistance* | +0.05 | +0.28 |

*The change in the density of the unexposed portion after the samples were exposed to a fluorescent lamp (Macbeth prooflite viewer Model TLT-510, a trade name for a product of Macbeth Color & Photometry Division Kollmorgen Corp.) having a color temperature of 5000° K for 2 hours.

EXAMPLE 10

To the second composition used in Example 7 containing, for example a reducing agent (2,6-di-t-butyl-p-cresol) was added a dye sensitizer of the formula:

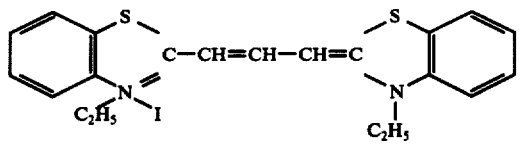

The same procedure as that for preparing Sample-F in Example 7 was repeated except that the above-mentioned composition was substituted for the second composition to prepare Sample-J.

This sample was measured with respect to the characteristics in the same manner as in Example 7 to obtain the results shown in the following table.

| | Sample-H | Sample-J |
|---|---|---|
| Relative Sensitivity | 1 | 2.2 |
| Maximum Density | 1.2 | 1.2 |
| Fog Density | 0.2 | 0.3 |

In addition, the relative sensitivity was calculated from the relation between the exposure amount and the density of the image which was formed by exposing the sample to a tungsten lamp (5000 lux) through a grey scale followed by the heat development.

We claim:

1. In a heat developable photosensitive material comprising an organic silver salt, a silver halide and a reducing agent, the improvement comprising said heat developable photosensitive material further containing, as a component for producing fogless and stable images of high contrast, at least one member selected from the group consisting of sulfur an sulfur compounds of the formulae:

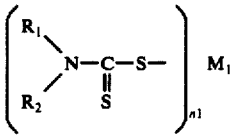

(1)

wherein $R_1$ and R2 are similar or dissimilar and are selected from the group consisting of hydrogen, alkyl, alkanoyl, phenyl, tolyl, xylyl, benzyl, and a heterocyclic group, $M_1$ is selected from the group consisting of a metal ion, an ammonium ion, an alkylammonium ion and a heterocyclic ion, and $n_1$ is determined depending upon the valency of $M_1$ and is an integer of 1-3;

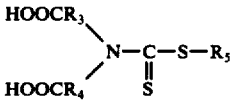

(2)

wherein $R_1$ and $R_2$ are similar or dissimilar and are lected from the group consisting of alkylene, phenylene, tolylene, dimethyl phenylene, and

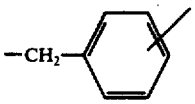

where the methylene group is attached to the nitrogen atom and the floating radical in the benzene ring to the carboxyl group, and $R_5$ is alkyl; and

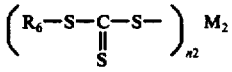

(3)

wherein $R_6$ is selected from the group consisting of hydrogen, alkyl, alkanoyl, phenyl, toyl, xylyl, benzyl and a heterocyclic group, $M_2$ is selected from the group consisting of metal ion, an ammonium ion, an alkylamonium ion and a heterocyclic ion, and $n_2$ is determined depending upon the valency of $M_2$ and is an integer of 1-3.

2. The heat developable photosensitive material according to claim 1 in which $R_1$, $R_2$ and $R_6$ are similar or dissimilar and are alkyl having 1-5 carbon atoms.

3. The heat developable photosensitive material according to claim 1 in which $R_1$, $R_2$ and $R_6$ are similar or dissimilar and are acyl having 1-4 carbon atoms.

4. The heat developable photosensitive material according to claim 1 in which $R_1$, $R_2$ and $R_6$ are similar or dissimilar and are heterocyclic groups selected from the group consisting of benzothiazolyl, indolyl and oxazolyl.

5. The heat developable photosensitive material according to claim 1 in which $R_3$ and $R_4$ are similar or dissimilar and are alkylene having 1-5 carbon atoms.

6. The heat developable photosensitive material according to claim 1 in which $R_5$ is alkyl having 1-5 carbon atoms.

7. The heat developable photosensitive material according to claim 1 in which, in the groups comprising $R_1$-$R_6$ with the exception of hydrogen, said groups are substituted by at least one substitutent selected from the group consisting of halogen, nitro, carboxyl and amino.

8. The heat developable photosensitive material according to claim 1 in which $M_1$ and $M_2$ are a metal ion selected from the group consisting of Li, Na, K, Rb, Cs, Cu, Ag, Au, Be, Mg, Ca, Sr, Ba, Zn, Cd, Hg, Al, Ga, In, Tl, Sn, Pb, Sb, Bi, Se, Te, Cr, Mo, Mn, Fe, Co, Ni, Pd, Pt, Rh and Ir.

9. The heat developable photosensitive material according to claim 1 in which $M_1$ and $M_2$ are a metal ion selected from the group consisting of K, Na, Fe, Zn, Cu and Ag.

10. The heat developable photosensitive material according to claim 1 in which $M_1$ and $M_2$ are an alkyl ammonium ion having 1-3 carbon atoms.

11. The heat developable photosensitive material according to claim 1 in which $M_1$ and $M_2$ are selected from the group consisting of dimethylammonium and diethylammonium.

12. The heat developable photosensitive material according to claim 1 in which $M_1$ and $M_2$ are a heterocyclic group selected from the group consisting of benzothiazolyl, indolyl and oxazolyl.

13. The heat developable photosensitive material according to claim 1 in which said component is contained therein in an amount of 0.01-10% by weight based on the weight of the organic silver salt.

14. The heat developable photosensitive material according to claim 1, in which said component is contained therein in an amount of 0.05-1% by weight based on the weight of the organic silver salt.

15. The heat developable photosensitive material according to claim 1, wherein said organic silver salt, said silver halide and said reducing agent are dispersed in an electrically insulating medium forming a photosensitive layer which overlies a supporting substrate.

16. The heat developable photosensitive material according to claim 15, in which said supporting substrate comprises a metal plate, a metal laminate paper, a paper which has been treated to prevent a solvent from penetrating therein, a paper treated with a conductive polymer, and a plastic.

17. The heat developable photosensitive material according to claim 1, wherein said oganic silver salt comprises an aliphatic acid silver salt containing not more than 25 carbon atoms.

18. The heat developable photosensitive material according to claim 1, in which said organic silver salt is selected from the group consisting of silver behenate, silver arachidate, silver stearate, silver palmitate, silver myristate, silver laurate, silver caprylate, silver hydroxystearate, silver acetate, silver butyrate, silver benzoate, silver 4-n-octadecyloxydiphenyl-4-carboxylate, silver-o-aminobenzoate, silver acetoamidobenzoate, silver furoate, silver comphorate, silver p-phenylbenzoate, silver phenyl acetate, silver salicylate, silver terephthalate, silver phthalate, silver acid phthalate, silver phthalazinone, silver benzotriazole, and silver saccharine.

19. The heat developable photosensitive material according to claim 1, in which said silver halide is formed by reaction between said organic silver salt and an inorganic halide wherein the amount of inorganic halide mixed with said organic silver salt to form said silver halide is not more than 10% by weight, based on the weight of said organic silver salt.

20. The heat developable photosensitive material according to claim 19 wherein the amount of inorganic halide mixed with said organic silver salt is from 0.001 to 10% by weight, based on the weight of said organic silver salt.

21. The heat developable photosensitive material according to claim 1 further comprising dye sensitizers, toning agents and stabilizers.

22. The heat developable photosensitive material according to claim 1 in which said reducing agent is selected from the group consisting of hydroquinone, methyl hydroquinone, chlorohydroquinone, bromohydroquinone, catechol, pyrogallol, methylhydroxynaphthalene, aminophenol, 2,2'-methylene-bis-(6-t-butyl-4-methylphenol), 4,4'-butylidene-bis-(6-t-butyl-3-methylphenol), 4,4'-bis-(6-t-butyl-3-methylphenol), 4,4'-thio-bis-(6-t-2-methylphenol), octadecyl-3-(3'5'-di-t-butyl-4'-hydroxyphenyl)propionate, 2,6-di-t-butyl-p-cresol,2,2'-methylene-bis--(4-ethyl-6-t-butylphenol), phenidone, metol, 2,2'-dihydroxy-1,1'-binaphthyl,6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and mixtures thereof.

23. The heat developable photosensitive material according to claim 15 wherein said insulating medium is selected from the group consisting of polystyrene resin, polyvinyl chloride resin, phenolic resin, polyvinyl acetate resin, polyvinyl acetal resin, epoxy resin, xylene resin, alkyd resin, polycarbonate resin, poly (methylmethacrylate) resin, polyvinyl butyral resin, gelatin resin, polyester, polyurethane, acetyl cellulose, synthetic rubber, and polybutene.

24. The heat developable photosensitive material according to claim 15 wherein said insulating medium is present in said photosensitive layer in an amount of from 0.02 to 20 parts by weight per 1 part by weight of said organic silver salt.

* * * * *